US008038137B2

(12) United States Patent
Hug

(10) Patent No.: US 8,038,137 B2
(45) Date of Patent: Oct. 18, 2011

(54) DEVICE WITH A DISPLACEABLE STACKING DEVICE OR CHARGING DEVICE TO PRODUCE PRINT MATTER

(75) Inventor: Theo Hug, Wallenwil (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/611,576

(22) Filed: Nov. 3, 2009

(65) Prior Publication Data

US 2010/0109225 A1 May 6, 2010

(30) Foreign Application Priority Data

Nov. 3, 2008 (EP) ..... 08405273

(51) Int. Cl.
*B65H 39/02* (2006.01)

(52) U.S. Cl. ..... 270/52.22; 270/52.16; 270/52.26; 270/52.29

(58) Field of Classification Search ..... 270/52.14, 270/52.16, 52.19, 52.2, 52.21, 52.22, 52.26, 270/52.29, 58.23, 58.26
See application file for complete search history.

(56) References Cited

U.S. PATENT DOCUMENTS

| | | | | |
|---|---|---|---|---|
| 3,809,385 | A * | 5/1974 | Rana | 270/52.29 |
| 4,177,979 | A * | 12/1979 | Orsinger et al. | 270/52.16 |
| 5,876,029 | A | 3/1999 | Wright et al. | |
| 6,682,062 | B2 * | 1/2004 | Graushar et al. | 270/1.02 |
| 6,776,412 | B2 * | 8/2004 | DaCunha et al. | 271/274 |
| 6,832,758 | B2 * | 12/2004 | Richter et al. | 271/8.1 |
| 6,916,018 | B2 * | 7/2005 | Graushar et al. | 270/4 |
| 7,494,117 | B2 * | 2/2009 | Peier | 270/52.26 |
| 7,571,903 | B2 * | 8/2009 | Desfosses et al. | 270/52.2 |
| 2003/0047857 | A1 * | 3/2003 | Peier | 270/52.16 |
| 2006/0103064 | A1 * | 5/2006 | Sittinger et al. | 270/52.14 |
| 2008/0042338 | A1 * | 2/2008 | Desfosses et al. | 271/9.13 |

FOREIGN PATENT DOCUMENTS

| | | |
|---|---|---|
| EP | 536 463 | 4/1993 |
| EP | 536 863 | 4/1993 |
| EP | 1 520 817 | 4/2005 |
| EP | 1 604 925 | 12/2005 |
| GB | 928 225 | 6/1963 |
| WO | WO-2008/024313 | 2/2008 |
| WO | WO-2008/093296 | 8/2008 |

OTHER PUBLICATIONS

European Search Report Issue in Priority Application No. 08405273.7.

* cited by examiner

*Primary Examiner* — Patrick Mackey
(74) *Attorney, Agent, or Firm* — Venable LLP; Robert Kinberg; Leigh D. Thelen

(57) ABSTRACT

A device to supply flat products to produce print matter that includes a machine frame, a guide arrangement coupled to the machine frame, and a conveyor with a conveying direction arranged on the machine frame. The device additionally includes at least one sheet feeder arranged along the conveyor to supply a respective flat product to the conveyor in a clocked operation. The sheet feeder includes a stacking device to accommodate a plurality of flat products and a charging device coupled to the stacking device to remove a respective flat product from the stacking device. At least one of the stacking device or the charging device is operatively arranged with the guide arrangement to be displaceable to a non-operating position on a side of the conveyor.

13 Claims, 5 Drawing Sheets

DEVICE WITH A DISPLACEABLE STACKING DEVICE OR CHARGING DEVICE TO PRODUCE PRINT MATTER

CROSS-REFERENCE TO RELATED APPLICATION

This application claims the priority of European Patent Application No. 08405273.7, filed on Nov. 3, 2008, the subject matter of which is incorporated herein by reference.

FIELD

The subject matter of the application relates to a device for supplying flat products or printed sheets for producing book blocks, books or similar print matter. The device includes a plurality of sheet feeders, arranged successively and spaced-apart on a machine frame, above and along a conveyor. The sheet feeders function to supply the conveyor with individual printed sheets in a clocked operation. A stacking device for accommodating the stacked printed sheets is coupled to each sheet feeder. The stacking device further includes a loading or charging device for removing individual printed sheets from the stacking device.

Devices of the aforementioned type are used in different ways for collecting individual printed sheets for producing print matter. They are designed to separate flat products used in the print industry, such as, but not limited to, envelopes, folded sheets, cards, CDs/DVDs or similar flat items made available in a stacked formation. The devices collect these products in a conveyor for conveying them to a processing machine, e.g. an adhesive binder. The conveyor may include a horizontal or inclined channel, extending transverse to the conveying direction, through which the unfinished print products may be pushed with the aid of pushers attached to a traction device. The channel may be open at the top, with the unfinished print products positioned in a stable manner therein as a result of their inherent weight or with the use of guide arrangements. Alternately, the unfinished print products may also be deposited and collected inside of circulating compartments.

According to the European Patent Application EP 1 520 817, devices embodied in this way are used for collecting unfinished print products such as printed sheets, cards, CDs/DVDs or similar flat products to combine them into loose book blocks. For this, feeders are arranged along a conveyor together with a stack of unfinished print products, wherein these feeders are designed to separate and remove the unfinished products and supply the products in a clocked operation to the conveyor such that the stack is oriented perpendicular to the conveying direction. The conveyor is provided with receptacles, attached uniformly spaced apart to a circulating, driven traction device, to which the unfinished print products may be supplied in the predetermined sequence by the feeders. The feeders are arranged above the conveyor, spaced apart at short distances that may be short enough for successive feeders to overlap each other. This compact design allows only limited access to the conveyor for maintenance operations or for correcting malfunctions that require an intervention in the conveyor region.

European patent documents EP 536 863 A1 and EP 536 463 A1 relate to a device for collecting and feeding different types of covers or casings to an adhesive binder. The different covers must be supplied to the book blocks to be bound during the same production run, depending on the recipient, wherein feeders, as well as covers that are gathered into a stack, are arranged along the conveyor. The stacks consist of covers, which are arranged one above the other on a table and then separated by the feeder and supplied to the conveyor, wherein a machine control activates the respective feeder holding the type of cover needed for the print product to be produced. As with the previously described European Patent Application EP 1 520 817, the feeders are arranged above the conveyor, at a short distance relative to each other, which may also be short enough so that successive feeders overlap in the manner of a scale. As a result, similar disadvantages may be encountered with respect to maintenance operations or the correction of malfunctions requiring intervention in the region of the conveyor.

According to the subject matter of the application, the table may be pivoted upward around a horizontal axis that is arranged in one of its end regions, thus allowing easy access to the conveyor. The table may be emptied ahead of time and may then be filled again, which may require additional operating personnel. The feeders may be utilized when processing identical covers which may allow for a higher storage capacity of the feeders.

SUMMARY

Embodiments of the invention provide for a collecting device for unfinished print products, comprising sheet feeders that are arranged overlapping and directly above the conveyor which provide easy and unobstructed access.

According to one aspect of an embodiment of the invention, there is provided a device to supply flat products to produce print matter, comprising: a machine frame; a guide arrangement coupled to the machine frame; a conveyor with a conveying direction arranged on the machine frame; at least one sheet feeder arranged along the conveyor to supply a respective flat product to the conveyor in a clocked operation, the at least one sheet feeder including a stacking device to accommodate a plurality of flat products, and a charging device coupled to the stacking device to remove a respective flat product from the stacking device, wherein at least one of the stacking device or the charging device is operatively arranged with the guide arrangement to be displaceable to a non-operating position on a side of the conveyor.

According to another embodiment of the invention, there is provided a method for supplying flat products to produce print matter by a device, comprising accommodating flat products stacked one above the other in a stacking device of a sheet feeder; removing, by a charging device of a sheet feeder, a respective flat product from the stacking device; supplying the respective flat product to a conveyor with a same clocking rate and in approximately a same direction as a conveying direction of the conveyor; and displacing at least one of the stacking device or the charging device to a non-operating position on a side of the conveyor.

The objects are solved according to the subject matter of the application in that the stacking device or the charging device of a sheet feeder may be moved to a non-operating position on the side of the conveyor with the aid of a guide arrangement that is connected to the machine frame.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
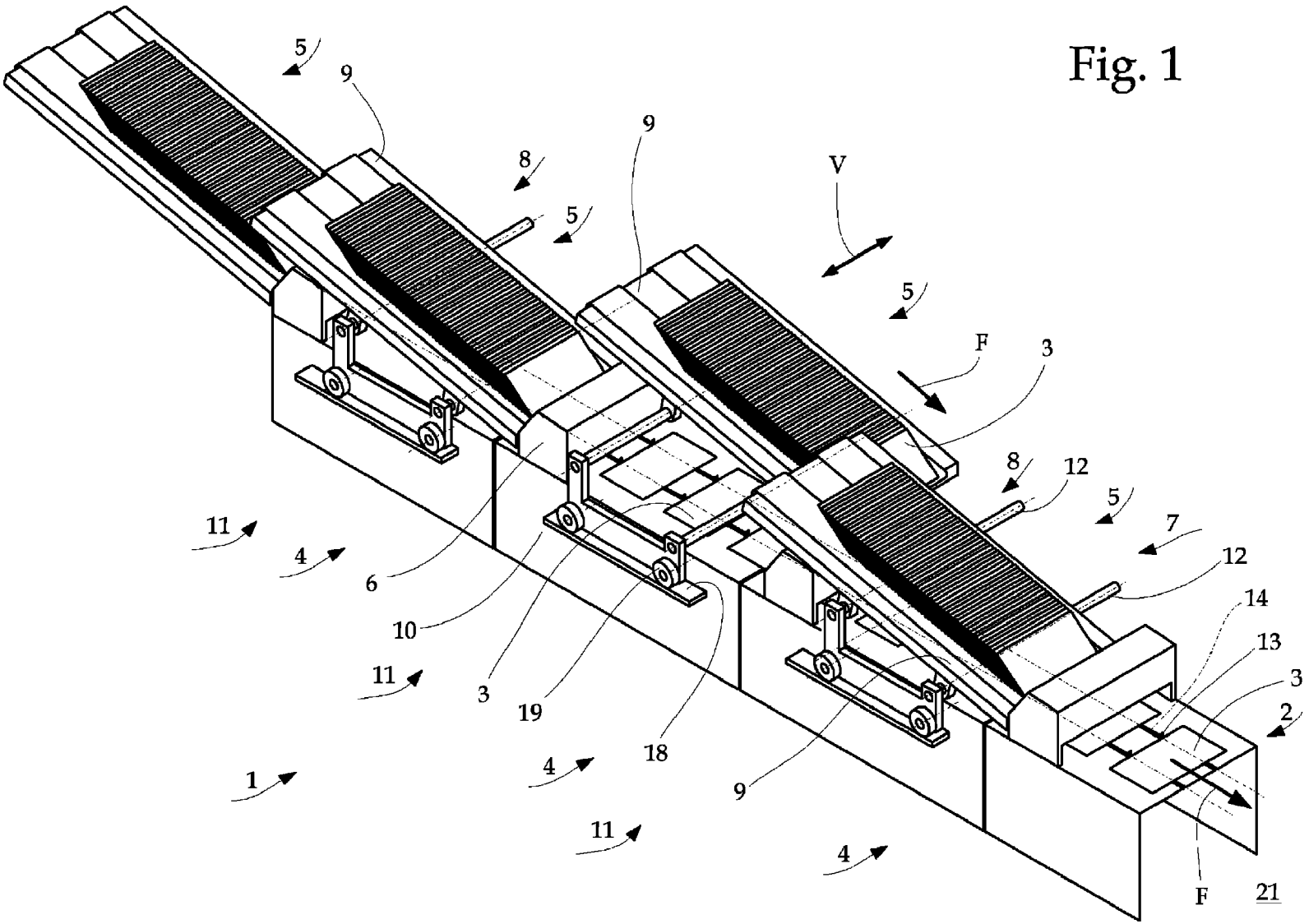
FIG. 1 is a three-dimensional view of a first embodiment of a collecting device for covers.
Figure 2:
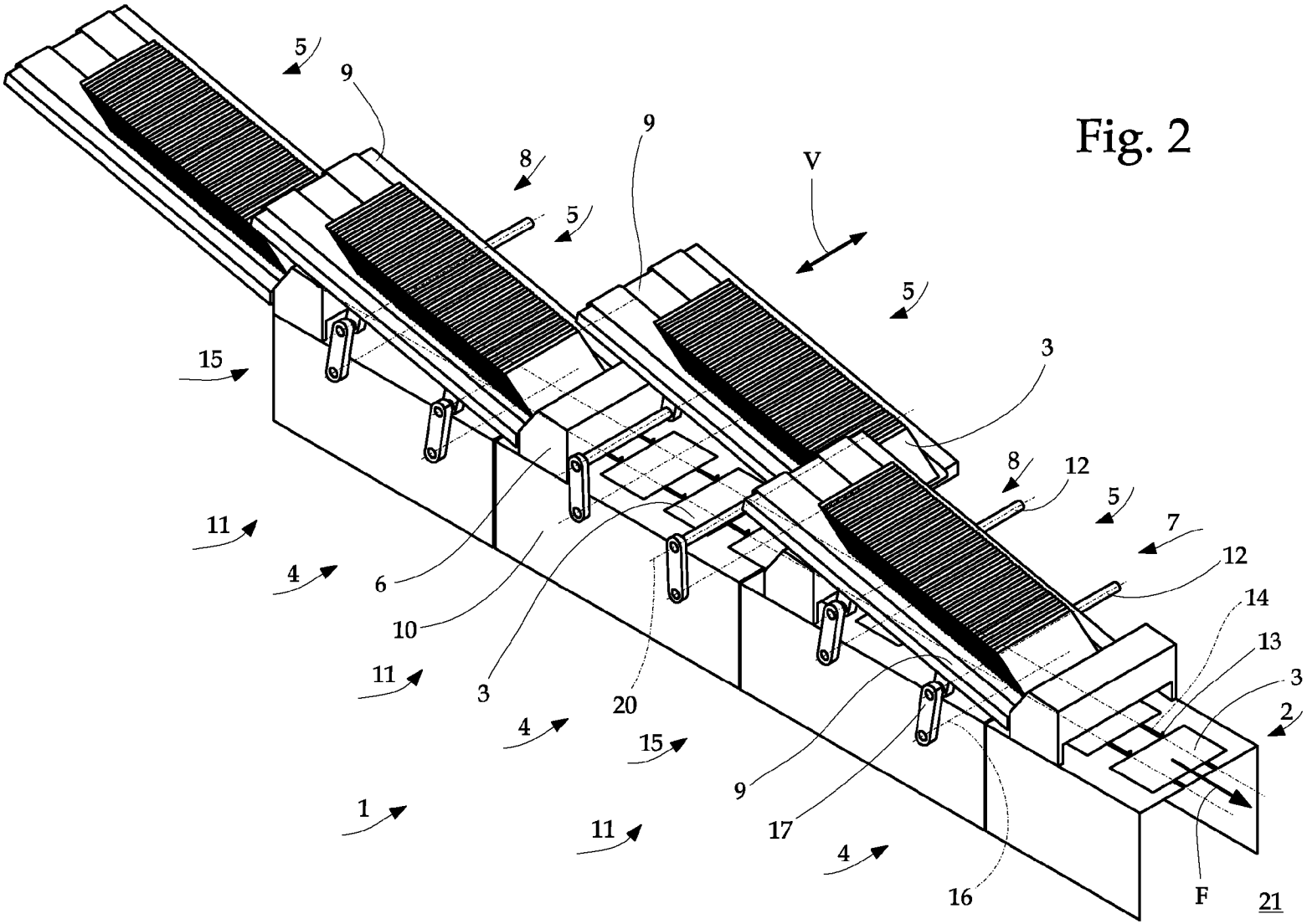
FIG. 2 is a three-dimensional view of a second embodiment of a collecting device for covers.

FIGS. 1 and 2 show a collecting device 1 for supplying printed sheets or flat products 3 for producing book blocks, books or similar print matter. The device 1 includes a sheet feeder 4 that may be embodied as cover feeder 11 for supplying covers, or other flat objects, such as, but not limited to, CDs/DVDs, goods samples, or brochures, to an adhesive binder 21. The collecting device 1 may include a plurality of sheet feeders 4, arranged successively and uniformly spaced apart above and along a conveyor 2 on a machine frame 10.

The sheet feeders may each include an assigned stacking device 5 and a charging device 6 for supplying the conveyor 2 in a clocked operation with individual printed sheets 3 that may be removed from the stacking device 5. The conveyor 2 that may be coupled to the machine frame 10 and essentially forms a channel in which uniformly spaced apart pushers 13 may be driven to circulate by a traction device 14. The pushers 13 may convey the printed sheets 3 or the covers supplied by the sheet feeder 4 by pushing them along the channel extending over the length of the conveyor 2.

Figure 4:
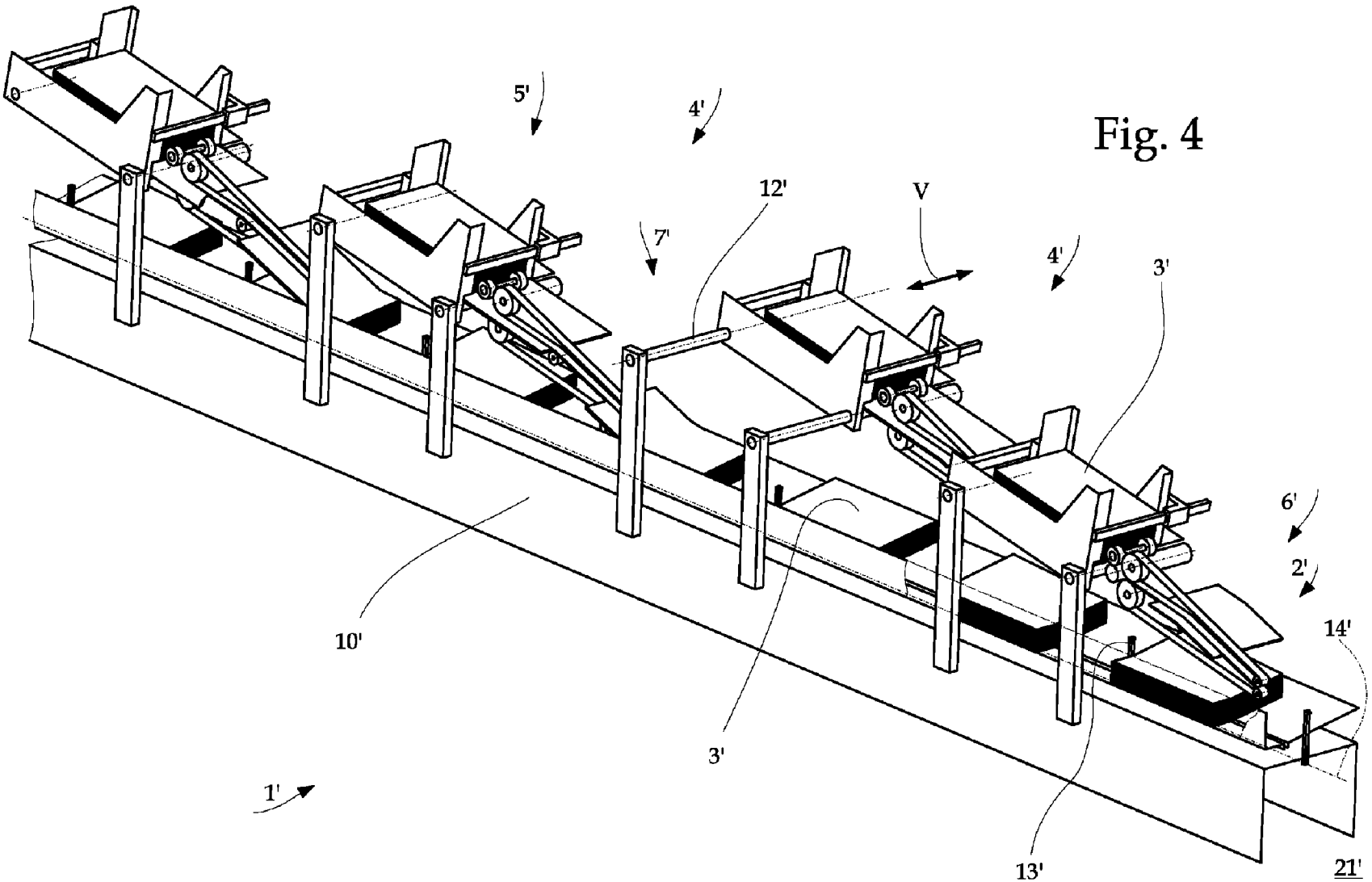
FIG. 4 depicts the collecting device according to FIG. 3, showing a sheet feeder in the non-operating position.

The sheet feeder 4 may be provided with a conveying table 9 for accommodating the printed sheets 3, supplied in an overlapping formation 8. The conveying table 9 may form the stacking device 5 and may be inclined in the direction of the charging device 6. At least the stacking device 5 or the conveying table 9 of the sheet feeder 4 may be displaced to the side of the conveyor 2 with the aid of a guide arrangement 7. The guide arrangement 7 may be coupled to the machine frame 10. The guide arrangement may include guides 12 and have a displacement direction V that extends transverse to the conveying direction F, as depicted in FIG. 4. The conveying table 9 or the stacking device 5 may be uncoupled from the charging device 6 and may be moved to the non-operating position on the side of the conveyor 2. According to another embodiment, the conveying table 9 may be uncoupled from the charging device 6, such that it may be displaced counter to the conveying direction F.

FIG. 1 shows that the conveying table 9 may be positioned to be displaced on rolls 19 along rails 18. The rolls 19 and rails 18 may be coupled to the machine frame 10, either horizontally or slightly ascending in the direction counter to the conveying direction F, wherein other kinds of linear guides are conceivable.

In the embodiment of FIG. 2, the conveying table 9 may be displaced by using an articulated arrangement 15, including levers 17 that may be pivoted around pivoting axes 16. The end positions of the levers 17 may be selected such that the axes 20 in the two end positions may rest on different sides, relative to the pivoting axes 16. Both end positions may be stable because of the gravitational force. The conveying table 9 may either be displaced manually in conveying direction F or in displacement direction V, or it may be displaced with the aid of an electric, pneumatic or hydraulic drive (not shown). The stacking device may also be displaced in a direction extending between the conveying direction F and the displacement direction V. These movements may also be superimposed in two directions, a rotation around an essentially perpendicular axis or a lifting.

Figure 3:
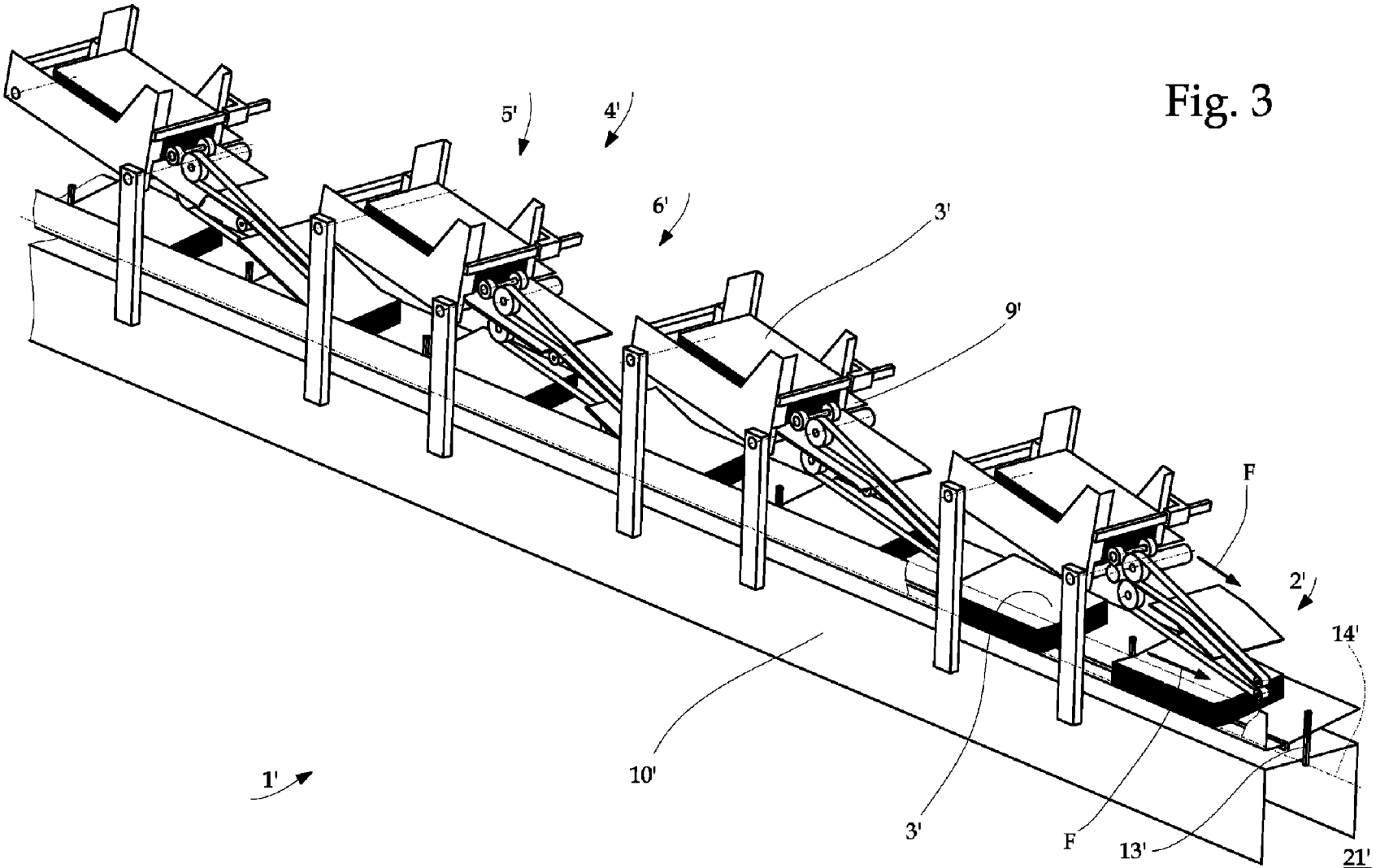
FIG. 3 is a three-dimensional view of a collecting device for printed sheets, for which the sheet feeders are in the operating position.
Figure 5:
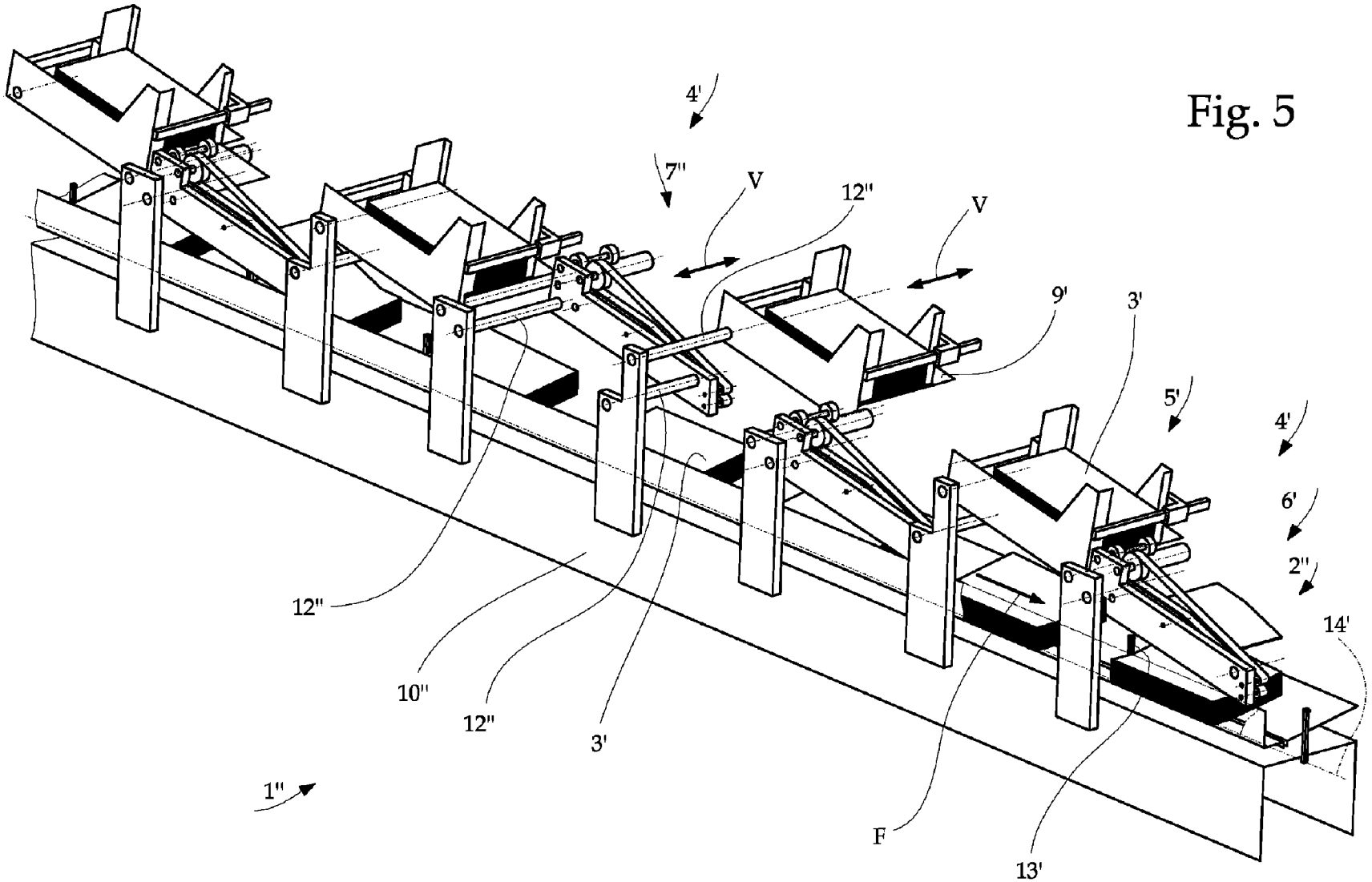
FIG. 5 is a three-dimensional view of a collecting device for printed sheets with sheet feeders, showing a different embodiment.

FIGS. 3 to 5 show another embodiment wherein a collecting device 1' is provided for collecting printed sheets 3' in a predetermined sequence into loose book blocks, which may be subsequently supplied to a perfect binder 21' and are bound therein. The collecting device 1' that may be operatively connected to the perfect binder 21' is provided with at least one sheet feeder 4'. The sheet feeder 4' includes a stacking device 5' that accommodates the printed sheets 3, stacked one above the other on a conveying table 9', and a charging device 6' that removes the printed sheets 3' from the stacking device 5' and supplies the sheets to a conveyor 2' in approximately the same direction as the conveying direction F and with the same speed. The printed sheets 3' may be separated and removed by the sheet feeder 4'. The sheets may then be deposited on a conveyor 2' which may be arranged below the sheet feeder 4'. The collecting device 1' may also include a guide arrangement 7' with guides 12'.

The conveyor 2' that is coupled to the machine frame 10' may essentially include a driven, circulating traction device 14' with thereon arranged, uniformly spaced apart pushers 13'. The pushers 13' may push the printed sheets 3', supplied by the sheet feeder 4', along a channel that extends over the length of the conveyor 2'. According to an alternate embodiment, the conveyor 2' may be embodied with depositing tables, attached with regular spacing to the traction device 14', on which the printed sheets 3' are collected into loose book blocks. For space-saving design considerations, the sheet feeders 4' may be successively arranged at distances that are short enough to allow the feeders to overlap partially in a vertical direction.

FIG. 5 shows an embodiment of the collecting device 1" where the stacking device 5' or the charging device 6' of the sheet feeder 4' is arranged on a guide arrangement 7" that is connected to the machine frame 10" which may allow easy access to the conveyor 2". The guide arrangement 7" may be formed with the aid of guides 12", such that the stacking device 5' may be displaced in the direction V and transverse to the conveying direction F to a non-operating position on the side of the conveyor 2". With the collecting device 1' shown in FIGS. 3 and 4, the stacking device 5' and the charging device 6' of the sheet feeder 4' may be fixedly connected to each other and the sheet feeder 4' consequently may be displaced as a single unit into a non-operating position on the side of the conveyor 2'. Even though the non-operating position is shown for all Figures to be on the left side of the conveyors 2, 2', 2" as seen in conveying direction F, the non-operating position may also be arranged on the right side of the conveyors 2, 2', 2".

It will be understood that the above description of the present invention is susceptible to various modifications, changes and adaptations, and the same are intended to be comprehended within the meaning and range of equivalents of the appended claims.

What is claimed is:

1. A device to supply flat products to produce print matter, comprising:

a machine frame;

a guide arrangement coupled to the machine frame;

a conveyor with a conveying direction arranged on the machine frame;

at least one sheet feeder arranged along the conveyor to supply a respective flat product to the conveyor in a clocked operation, the at least one sheet feeder including a stacking device to accommodate a plurality of flat products, and a charging device coupled to the stacking device to remove a respective flat product from the stacking device, wherein the guide arrangement is operatively arranged to displace at least one of the stacking device or the charging device from an operating position to a non-operating position on a side of the conveyor while the at least one of the stacking device or the charging device is supported by the machine frame.

2. The device according to claim 1, wherein the at least one sheet feeder includes as the stacking device a slanted conveying table which slants toward the charging device so that the flat products supplied to the conveying table overlap, wherein the conveying table is selectively uncoupled from the charging device and displaceable to the non-operating position on the side of the conveyor.

3. The device according to claim 2, wherein the conveying table is detachable from the charging device and displaceable counter to the conveying direction.

4. The device according to claim 3, further comprising an articulated arrangement to permit pivoting the conveying table in a direction parallel to the conveying direction.

5. The device according to claim 2, wherein the conveying table is displaceable inside the guide arrangement.

6. A device according to claim 1, further comprising a plurality of sheet feeders successively arranged with uniform spacing above the conveyor.

7. A combination comprising an adhesive binder and the device according to claim 1, wherein the sheet feeder is operatively coupled to the adhesive binder.

8. A method for supplying flat products to produce print matter by a device, comprising accommodating flat products stacked one above the other in a stacking device of a sheet feeder;

removing, by a charging device of a sheet feeder, a respective flat product from the stacking device;

supplying the respective flat product to a conveyor with a same clocking rate and in approximately a same direction as a conveying direction of the conveyor; and displacing at least one of the stacking device or the charging device from an operating position to a non-operating position on a side of the conveyor while the at least one of the stacking device or the charging device is supported by the machine frame.

9. A device to supply flat products to produce print matter, comprising:

a machine frame;

a guide arrangement coupled to the machine frame;

a conveyor with a conveying direction arranged on the machine frame;

at least one sheet feeder arranged along the conveyor to supply a respective flat product to the conveyor in a clocked operation, the at least one sheet feeder comprising a slanted conveying table, the at least one sheet feeder including a stacking device to accommodate a plurality of flat products, and a charging device coupled to the stacking device to remove a respective flat product from the stacking device, wherein the slanted conveying table slants toward the charging device so that the flat products supplied to the conveying table overlap, wherein at least one of the stacking device or the charging device is operatively arranged with the guide arrangement to be displaceable to a non-operating position on a side of the conveyor, wherein the conveying table is selectively uncoupled from the charging device and displaceable to the non-operating position on the side of the conveyor.

10. The device according to claim 9, wherein the conveying table is detachable from the charging device and displaceable counter to the conveying direction.

11. The device according to claim 10, further comprising an articulated arrangement to permit pivoting the conveying table in a direction parallel to the conveying direction.

12. The method according to claim 8, wherein the supplying further comprises overlapping the flat products by the stacking device, wherein the stacking device comprises a slanted conveying table which slants toward the charging device; and wherein the displacing further comprises selectively uncoupling the conveying table from the charging device and displacing the conveying table to the non-operating position on the side of the conveyor.

13. A method for supplying flat products to produce print matter by a device, comprising accommodating flat products stacked one above the other in a stacking device of a sheet feeder;

removing, by a charging device of a sheet feeder, a respective flat product from the stacking device;

supplying the respective flat product to a conveyor with a same clocking rate and in approximately a same direction as a conveying direction of the conveyor, wherein the supplying includes overlapping the flat products by the stacking device, wherein the stacking device comprises a slanted conveying table which slants toward the charging device; and displacing at least one of the stacking device or the charging device to a non-operating position on a side of the conveyor, wherein the displacing includes prises selectively uncoupling the conveying table from the charging device and displacing the conveying table to the non-operating position on the side of the conveyor.

* * * * *